United States Patent [19]

Breitbarth

[11] Patent Number: 4,864,983

[45] Date of Patent: Sep. 12, 1989

[54] PUSHROD RETAINER

[75] Inventor: Warren H. Breitbarth, Metamora, Ill.

[73] Assignee: Caterpillar Inc., Peoria, Ill.

[21] Appl. No.: 233,296

[22] Filed: Aug. 17, 1988

[51] Int. Cl.[4] ..... F01L 1/14

[52] U.S. Cl. ..... 123/90.61

[58] Field of Search ..... 123/90.61, 90.62, 90.63

[56] References Cited

U.S. PATENT DOCUMENTS

| | | | |
|---|---|---|---|
| 1,252,692 | 1/1918 | Harris | 123/90.61 |
| 1,499,573 | 7/1924 | Ennis | 123/90.61 |
| 1,565,712 | 12/1925 | Charnock | 123/90.61 |
| 2,346,737 | 4/1944 | Essl | 123/90.61 |
| 3,034,488 | 5/1962 | Reiners | 123/90.61 |
| 3,963,280 | 6/1976 | Irving | 308/5 V |

*Primary Examiner*—Charles J. Myhre
*Assistant Examiner*—Weilyn Lo
*Attorney, Agent, or Firm*—Larry G. Cain

[57] ABSTRACT

The design and construction of past pushrod retainers has required complex components, sliding relationships and additional assembly time and expense. The present invention overcomes these problems by using a retainer attached to a first end of the rocker arm. Thus, the components are simple to install, imexpensive to manufacture and do not increase assembly time since there is no adjustment necessary when using the device. The present pushrod retainer provides a device which retains the cupped end of the pushrod in a pre-established proximity to the first end of the rocker arm and prevents extensive damage to the engine caused by a large separation between the cupped end of the pushrod and the first end of the rocker arm which allows the pushrod to fall into other components and resulting in malfunction of the engine. The device cradles the cupped end and prevents the pushrod from tipping or falling to one side. The device is preassembled to the rocker arm and requires no additional assembly time or alignment when assembling the engine. The device is inexpensive to manufacture and only contacts the pushrod when a malfunction of the engine occurs.

20 Claims, 4 Drawing Sheets

PUSHROD RETAINER

TECHNICAL FIELD

This invention relates generally to an engine or compressor and more particularly to a pushrod retainer or locator.

BACKGROUND ART

Many engines and compressors use a camshaft, a pushrod and a rocker arm mechanism to functionally operate valves and/or unit fuel injectors. Typically, such components operate as a tuned combination and the engine or compressor operates smoothly. However, under certain conditions such as engine overspeed, injector seizure or valve spring breakage, the upper end of the pushrod can lose contact with the rocker arm and fall to one side. When this happens, the rotating camshaft moves the pushrod into contact with nearby components of the engine with sufficient force to seriously damage the components of the engine. If misalignment of the pushrod and the cam follower occurs the rocker arm will no longer move the valves or the injector, thus malfunction of the engine will occur.

An example of a device to prevent this from occurring is disclosed in U.S. Pat. No. 3,963,280 issued to Phillip E. Irving on June 15, 1976. In such system, the pushrod guide or locator is attached to a stud on a cylinder head. The guide is made up of two planar portions having an angular and planar relationship to one another. This relationship is required to appropriately position the mounting to the engine with respect to the reciprocating movement of the pushrod. The guide has a slot therein in which a bushing having a peripheral groove is positioned. The bushing has a bore therein through which the pushrod passes. Angular and reciprocal movement of the pushrod is compensated for by the bushing's peripheral groove moving in the slot. A pushrod guide of this design requires a stamped or formed plate and a machined bushing to functionally guide and locate the pushrod. The movement of the bushing with respect to the plate will cause wear and eventual malfunctioning of the engine or compressor. Furthermore, the assembly of the plate to the head requires the plate to be attached and properly aligned with respect to the pushrod location. The assembly of the bushing, pushrod and plate during the assembly of the engine increases the alignment and assembly technique thus adding time and cost with the end result being reduced profitability.

The present invention is directed to overcome one or more of the problems set forth above.

DISCLOSURE OF THE INVENTION

In one aspect of the present invention, a pushrod retainer is adapted for use in an engine. The pushrod retainer comprises a rocker arm pivotally mounted to the engine and having a first end; the first end of the rocker arm being movable between a first and second operating position; means for biasing the first end of the rocker arm from the first operating position to the second operating position; a pushrod having a rocker arm end normally in contact with the first end of the rocker arm; means for reciprocating the pushrod and moving the first end of the rocker arm from the second operating position to the first operating position; and means for retaining the end of the pushrod in a pre-established proximity to the first end of the rocker arm so that potential damage to the engine is prevented should the biasing means fail to move the first end of the rocker arm to the second operating position, the retaining means being attached to the rocker arm.

The pushrod retainer provides a device which prevents extensive damage to the engine caused by a large separation between the pushrod and the first end of the rocker arm during a malfunction of the engine. The device cradles the pushrod within a pre-established proximity to the first end of the rocker arm and prevents the pushrod from tipping or falling to one side. The device is preassembled to the rocker arm and requires no additional assembly time or alignment when assembling the engine. The engine assembly uses a conventional procedure to assemble the pushrod and rocker arm components. The device is inexpensive to manufacture and only contacts the pushrod when a malfunction of the engine occurs, such as when an injector seizes or a spring breaks.

BEST MODE FOR CARRYING OUT THE INVENTION

Figure 1:
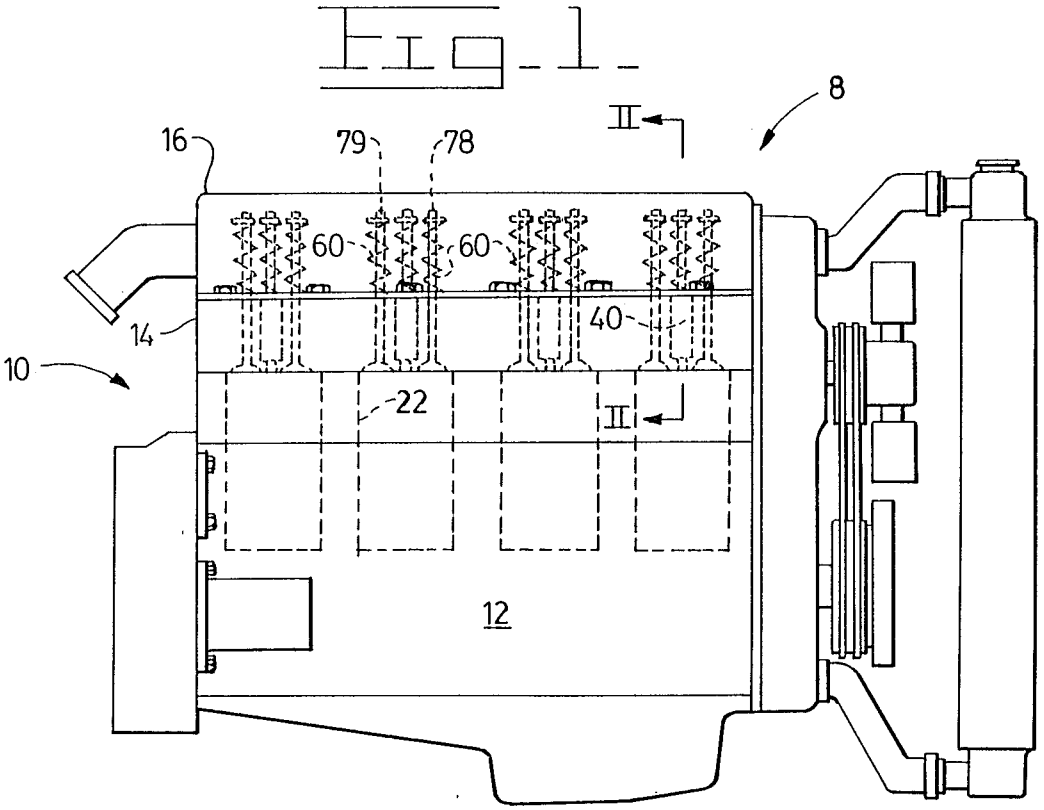
FIG. 1 is a side view of an internal combustion engine having an embodiment of the present invention.

Referring to the drawings, a pushrod retainer 8 has been adapted for us with a multi-cylinder engine 10. The engine 10 includes a cylinder block 12, a cylinder head 14 attached to the block 12 and a valve cover 16 attached to the head 14. These components are of a conventional design.

The block 12 includes a top mounting surface 20, a plurality of equally spaced in-line cylinder bores 22 perpendicularly positioned relative to the top mounting surface 20 and a longitudinally disposed through bore 24 spaced from the centers of the plurality of cylinder bores 22.

Figure 2:
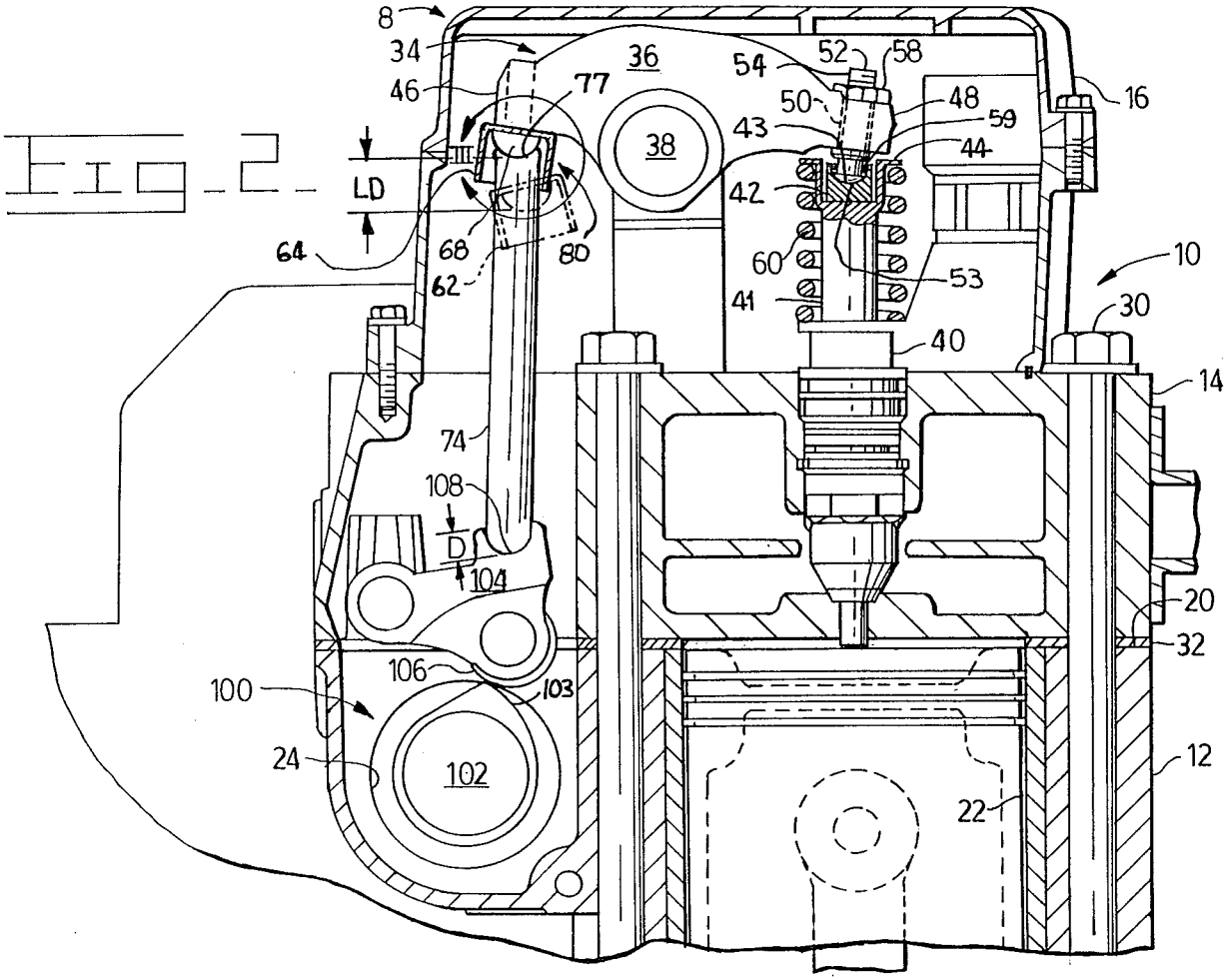
FIG. 2 is a sectional end view taken along lines II—II of FIG. 1.
Figure 3:
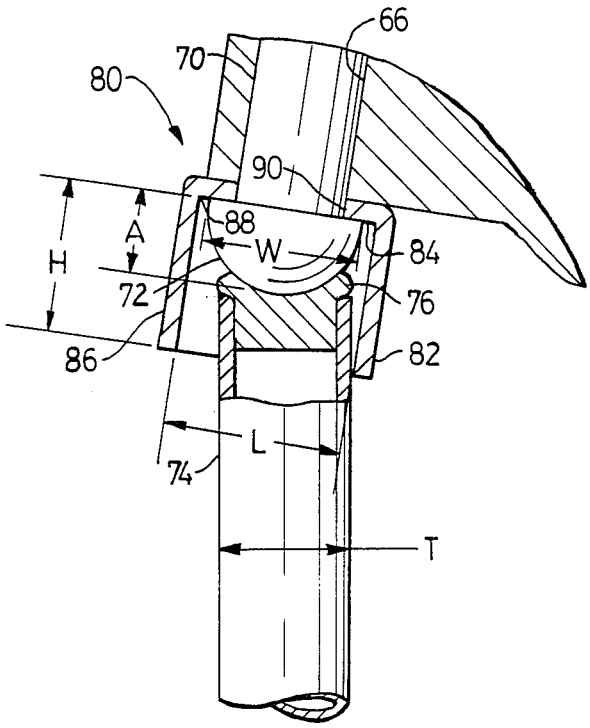
FIG. 3 is an enlarged view of the present invention as shown by line III of FIG. 2.

The cylinder head 14 is attached to the block 12 by a plurality of bolts 30. A gasket 32 is sealingly positioned between the head 14 and the block 12 in a conventional manner. A rocker arm assembly 34 is attached to the head 14 in a conventional arrangement. Each of the cylinders has an individual rocker arm assembly 34. The rocker arm assembly 34 includes a rocker arm 36 pivotally mounted on a shaft 38 non-rotatably attached to the head 14 in a conventional manner. The rocker arm 36, as shown in FIG. 2, activates a unit fuel injector 40. The injector include a body 41 having a bore therein not shown and a plunger 42 partially positioned in the bore. The plunger 42 has a concave recess 43 at one end and the body 41 has a flanged portion 44 surrounding one end. The rocker arms 36 has a first end 46 and an actuation end 48. The actuation end 48 is assembled in a conventional manner and has a threaded bore 50 therein. A screw 52 has a cylindrical head 53 and a turning end 54 at respective ends The screw 52 is adjustably positioned in the threaded bore 50 and a locking nut 58 abuts the rocker arm 36 retaining the screw 52 in the adjusted position. The cylindrical head 53 is positioned within the concave recess 43 and a flexible locking ring 59 is positioned intermediate the head 53 and the turning end 54 of the screw 52 and is positioned in the recess 43 connecting the rocker arm 36 to the unit fuel injector 40 in a mannor which allows the head 53 to be removed from the recess 43 should a force be applied thereto to remove the connection therebetween. Biasing means 60 is positioned between the body 41 and the flanged portion 44 of the injector 40. Thus, the biasing means 60 is positioned between the injector 40 and the actuation end 48 of the rocker arm 36. The biasing means 60 pivotally moves the first end 46 of the rocker arm 36 from a first operating position 62 wherein the unit fuel injector 40 is in the pumping position to a second operating position 64 wherein the unit injector 40 is in the filling position. The first end 46 has a through bore 66 therein. A pin 68 has a shank 70 and a spherical head 72 at one end. The head 72 has a thickness "A" and a width "W". The width of the head 72 is larger than the shank 70 which is press fitted into the bore 66 of the pushrod end 36 A pushrod 74 has a cupped end 76 having a contacting surface 77 normally in contact with the spherical head 72. A similar rocker arm is used with an intake and exhaust valve 78,79.

A means 80 for retaining the cupped end 76 of the pushrod 74 in a pre-established proximity to the first end 46 of the rocker arm 36 is attached to the rocker arm 36 so that potential damage to the engine 10 is prevented or at least minimized should the biasing means 60 fail to move the first end 46 of the rocker arm 36 to the second operating position 64. The retaining means 80 includes a single cupped shaped retainer 82 having a relatively flat base 84 and a continuous cylindrical wall 86 formed as a part of the base 84. The wall 86 and the base 84 has a radius 88 blended therebetween. The base 84 has a hole 90 slightly larger than the shank 70 and is smaller than the head 72. The hole 90 is generally centrally located therein and the shank 70 of the pin 68 passes therethrough, thus the head 72 which is larger than the hole 90 attaches the retainer 82 to the first end 46 of the rocker arm 36. The cylindrical wall 86 could be of any configuration such as a square or an octagon.

A means 100 for reciprocating the pushrod 74 and moving the first end 46 of the rocker arm 36 from the second operating position 64 to the first operating position 62 is positioned in the engine 10 The means 100 includes a camshaft 102 rotatably positioned in the bore 24 of the block 12 and is driven by a conventional mechanism not shown. The camshaft 102 has a profile cam portion 103 thereon. A roller cam follower 104 of conventional design is pivotally attached to the block 12 and is interposed between the profile cam portion 103 of the camshaft 102 and the pushrod 74. The roller cam follower 104 has a cylindrical roller 106 rotatably attached thereto and rides against the profile cam portion 103 in a conventional manner. A semi-spherical socket 108 of the follower 104 is positioned in contacting relationship to the pushrod 74 at an end opposite the cylindrical roller 106. The socket provides a pocket or nest in which the end of the pushrod opposite the cupped end 76 is nested. The socket or nest is of a depth or length sufficient to insure that the opposite end remains within the pocket even if the biasing means 60 fails to force the first end 46 of the rocker arm 36 into the second operating position 64.

The arcuate movement of the rocker arm 36 measured at a point on the contacting surface 77 results in a lineal distance "LD". The arcuate movement in this application is approximately 15° and results in the lineal distance "LD" being approximately 14mm between the first and second operating position 62,64.

Furthermore, the pushrod 74 has a mean thickness or diameter "T". The mean thickness takes into consideration that the cupped end 76 is larger than the remainder of the thickness of the pushrod 74 and that depending on the positional relationship of the pushrod 74 and the wall 86 this mean thickness dimension could vary. The wall 86 has a height "H" and an inside diameter "L". In this application, the mean thickness "T", the height "H" and the inside diameter "L" are approximately 20 mm, 23 mm and 25 mm respectively. A pre-established clearance between the inside diameter of the wall 86 as indicated by "L" and the mean thickness or diameter of the pushrod 74 as indicated by "T" provides an operating clearance so that the respective angular movement of the pushrod 74 and the rocker arm 36 does not cause interfere therebetween when the mechanism is operating normally. To insure that the wall 86 and the pushrod 74 have the pre-established clearance therebetween, the following variables must be considered. The inside diameter "L" must be larger than the mean thickness "T" and the angular movement of the pushrod 74 and the rocker arm 36 will cause the clearance to vary depending on the relationship therebetween. However, the larger the clearance between the pushrod 74 and the wall 84 the greater the possability that the pushrod 74 can escape the confines within the wall 84 and tilt or move from the pre-established proximity to the first end of the rocker arm 36. Thus, a ratio greater than 1 between the wall 86 and the pushrod 74 is desirable to insure functional operation of these components. Furthermore, when determining the height "H" of the wall 86 the following considerations must be included to insure that the cupped end 76 remains within the pre-established proximity to the first end 46 of the rocker arm 36. The thickness "A" of the head 72, the lineal distance "LD" and the overlap of the cupped end 76 and the head 72. For example, in this application the thickness "A" is equal to approximately 11 mm, the lineal distance "LD" is equal to approximately 14 mm and the amount of overlap is approximately 6 mm. Thus, to insure that the cupped end 76 remains within the pre-established proximity to the first end 46 of the rocker arm 36 the height "H" is 25 mm as stated above. Thus, a ratio of lineal distance "LD", movement between the first operating position 62 and the second operating position 64, and the height "H" of the wall 86 is greater than 1. As an alternative ratio, the amount of overlap required to insure that the cupped end 76 remains within the pre-established proximity to the first end 46 of the rocker arm 36 can be formulated. For example, the ratio of the lineal distance "LD" plus the thickness "A" minus the overlap of the cupped end 76 and the head 72 should be equal to or great than the height "H".

The semi-spherical socket 108 has a depth "D". The depth "D" is of a substantial length to insure that the end opposite the cupped end 76 remains within the socket even if the biasing means 60 fails to force the first end 46 of the rocker arm 36 into the second operating position 64. For example, in this particular application the depth "D" is equal to at least 14 mm.

Figure 4:
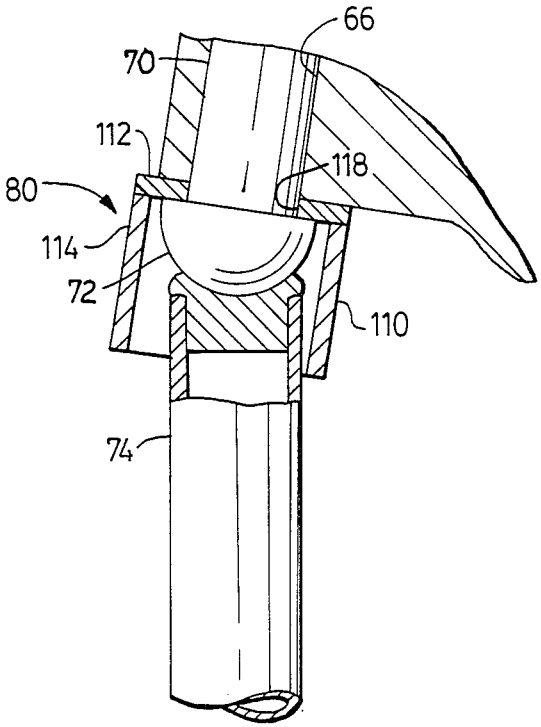
FIG. 4 is a sectional view of an alternate embodiment.

Alternatively, as shown in FIG. 4, the retaining means 80 could be a multi-piece retainer 110 having a relatively flat base 112 and a continuous cylindrical wall 114 formed about the base 112. The wall 114 and the base 112 are connected therebetween such as by welding. The base 112 has a hole 118 therein which is slightly larger than the shank 70 and is smaller than the head 72. The hole 118 is generally centrally located therein and the shank 70 of the pin 68 passes therethrough, thus the head 72 which is larger than the hole 118 attaches the retainer 110 to the first end 46 of the rocker arm 36.

Industrial Applicability

During normal operation of the engine 10, the camshaft 102 rotates the profile cam 103 and causes the roller cam follower 104 to reciprocally move the pushrod 74 and rotates the rocker arm 36 resulting in the first end 46 of the the rocker arm 36 being moved to the first operating position 62 activating the unit injector 40. As the profile cam 103 continues to rotate, the force on the pushrod 74 is relieved and the biasing means 60 moves the first end 46 of the rocker arm 36 from the first operating position 62 to the second operating position 64. Thus, the engine 10 continues to operate normally with the pushrod 36 reciprocally positioned between the roller cam follower 104 and the rocker arm 74.

An example of a malfunction which could occur and cause the first end 46 of the rocker arm 36 to remain in the first operating position would be if the injector 40 was to seize in the pumping position or with the rocker arm 36 in the first operating position. The operation of the engine 10 will be effected by this malfunction since the plunger 42 will not be able to fill. The camshaft 102 continues to rotate and causes the profile cam portion 103 to rotate and the force on the pushrod 74 is relieved but the biasing means 60 does not have the capability of moving the seized injector 40 to the filling position resulting in the first end 46 of the rocker arm 36 not being moved to the second operating position 64. Thus, as the profile cam portion 103 continues to rotate, the roller cam follower 104 will follow the contour of the profile cam portion 103 and the pushrod 74 will become free of contact with the roller cam follower 104 and/or the spherical head 72 resulting in the pushrod 74 being free to float. The semi-spherical socket 108 of the roller cam follower 104 has the depth "D" which will cradle the opposite end of the pushrod 74 therein and the cylindrical wall 86 has the height "H" to retain the cupped end 76 therein preventing the pushrod 74 from falling to one side and contacting other components of the engine 10. The cylindrical wall 86 of the retainer 82 has the height "H" of approximately 23 mm which is greater than the arcuate travel "LD" of approximately 14 mm so that the end 76 of the pushrod 74 is retained within the pre-established proximity to the first end 46 of the rocker arm 36. Thus, although the rotating camshaft 102 continues to reciprocate the pushrod 74, the pushrod 74 remains within the pre-established proximity to the first end 46 of the rocker arm 36 and the nearby components of the engine are protected from serious damage.

Other aspects, objects and advantages of this invention can be obtained from a study of the drawings, the disclosure and the appended claims.

I claim:

1. A pushrod retainer adapted for use in an engine, comprising:

a rocker arm pivotally mounted to the engine and having a first end, said first end being movable between a first and second operating positions;

means for biasing the first end of the rocker arm from the first operating position to the second operating position;

a pushrod having a cupped end normally in contact with the first end of the rocker arm;

means for reciprocating the pushrod and moving the first end of the rocker arm from the second operating position to the first operating position; and means for retaining the cupped end of the pushrod in a pre-established proximity to the first end of the rocker arm so that potential damage to the engine is prevented should said biasing means fail to move the first end of the rocker arm to the second operating position, said retaining means being attached to the rocker arm, said retaining means being attached to the first end of the rocker arm and including a cup shaped retainer positioned about the cupped end of the pushrod and having a wall confining the cupped end therein.

2. The pushrod retainer of claim 1, wherein said retainer has a generally cylindrical continuous wall shape extending from the rocker arm a distance at least equal to the distance between the first and second operation positions of the first end of the rocker arm.

3. The pushrod retainer of claim 2, wherein said retainer has a base attached to the rocker arm and cylindrical wall attached to the base.

4. The pushrod retainer of claim 3, wherein said rocker arm has a bore therein and said base has a hole therein and including a pin having a head at one end and a shank passing through the hole, said shank being press fitted in the bore in the rocker arm and said head attaches the retainer to the rocker arm.

5. The pushrod retainer of claim 3, wherein said cylindrical wall has an inside diameter "L" and said pushrod has a thickness "T" and a pre-established clearance is established between the inside diameter "L" and the thickness "T".

6. The pushrod retainer of claim 1, wherein said means for reciprocating the pushrod and moving the first end of the rocker arm from the second operating position to the first operating position results in an arcuate movement of the first end which has a lineal distance "LD" measured between the first position and the second position and said means for reciprocating includes a roller cam follower having a semi-spherical socket which has a depth "D" equal to at least the lineal distance "LD".

7. The pushrod retainer of claim 1, wherein said means for reciprocating the pushrod and moving the first end of the rocker arm from the second operating position to the first operating position results in an arcuate movement of the first end which has a lineal distance "LD" measured between the first position and the second position and said means for retaining includes a retainer having a cylindrical wall and said wall has a height "H" greater than the lineal distance "LD".

8. The pushrod retainer of claim 1, wherein said means for retaining includes a single piece cup shaped retainer which has a base and a continuous cylindrical wall attached to the base.

9. A pushrod retainer adapted for use in an engine, comprising:

a rocker arm pivotally mounted to the engine and having a first end, said first end being movable between a first and second operating positions;

means for biasing the first end of the rocker arm from the first operating position to the second operating position;

a pushrod having a cupped end normally in contact with the first end of the rocker arm;

means for reciprocating the pushrod and moving the first end of the rocker arm from the second operating position to the first operating position, said means including a roller cam follower having a semi-spherical socket cradling another end of the pushrod therein; and means for retaining the cupped end of the pushrod in a pre-established proximity to the first end of the rocker arm so that potential damage to the engine is prevented should said biasing means fail to move the first end to the second operating position, said retaining means being attached to the rocker arm, said retaining means being attached to the first end of the rocker arm and including a cup shaped retainer positioned about the cupped end of the pushrod and having a wall confining the cupped end therein.

10. The pushrod retainer of claim 9, wherein said retainer has a generally cylindrical continuous wall shape extending from the rocker arm a distance at least equal to the distance between the first and second operation positions of the first end of the rocker arm.

11. The pushrod retainer of claim 10, wherein said retainer has a base attached to the rocker arm and the cylindrical wall is attached to the base.

12. The pushrod retainer of claim 11, wherein said rocker arm has a bore therein and said base has a hole therein and including a pin having a head at one end and a shank passing through the hole, said shank being press fitted in the bore in the rocker arm and said head attaches the retainer to the rocker arm.

13. The pushrod retainer of claim 10, wherein said cylindrical wall has an inside diameter "L" and said pushrod has a thickness "T" and a pre-established clearance is established between the inside diameter "L" and the thickness "T".

14. The pushrod retainer of claim 9, wherein said means for reciprocating the pushrod and moving the first end of the rocker arm from the second operating position to the first operating position results in an arcuate movement of the first end which has a lineal distance "LD" measured between the first position and the second position and said means for reciprocating includes a roller cam follower having a semi-spherical socket which has a depth "D" equal to at least the lineal distance "LD".

15. The pushrod retainer of claim 9, wherein said means for reciprocating the pushrod and moving the first end of the rocker arm from the second operating position to the first operating position results in an arcuate movement of the first end which has a lineal distance "LD" measured between the first position and the second position and said means for retaining includes a retainer having a cylindrical wall and said wall has a height "H" greater than the lineal distance "LD".

16. The pushrod retainer of claim 9, wherein said means for retaining includes a single piece cup shaped retainer.

17. The pushrod retainer of claim 16, wherein said rocker arm has a bore therein and said base has a hole therein and including a pin having a head at one end and a shank passing through the hole, said shank being press fitted in the bore in the rocker arm and said head attaches the retainer to the rocker arm.

18. The pushrod retainer of claim 15, wherein said cylindrical wall has an inside diameter "L" and said pushrod has a thickness "T" and a pre-established clearance is established between the inside diameter "L" and the thickness "T".

19. The pushrod retainer of claim 16, wherein said means for reciprocating the pushrod and moving the first end of the rocker arm from the second operating position to the first operating position results in an arcuate movement of the first end which has a lineal distance "LD" measured between the first position and the second position and said means for reciprocating includes a roller cam follower having a semi-spherical socket which has a depth "D" equal to at least the lineal distance "LD".

20. The pushrod retainer of claim 16, wherein said means for reciprocating the pushrod and moving the first end of the rocker arm from the second operating position to the first operating position results in an arcuate movement of the first end which has a lineal distance "LD" measured between the first position and the second position and said means for retaining includes a retainer having a cylindrical wall and said wall has a height "H" greater than the lineal distance "LD".

* * * * *